US005134552A

United States Patent [19]

Call et al.

[11] Patent Number: 5,134,552

[45] Date of Patent: Jul. 28, 1992

[54] ACCELERATION ACTIVATED ENERGIZING DEVICE

[75] Inventors: John D. Call; Dennis J. Denen, both of Columbus, Ohio

[73] Assignee: Progenics Corporation, Columbus, Ohio

[21] Appl. No.: 735,854

[22] Filed: Jul. 25, 1991

[51] Int. Cl.[5] ..... F21L 7/00

[52] U.S. Cl. ..... 362/203; 362/109; 362/253; 362/276; 362/802; 273/416

[58] Field of Search ..... 362/203, 253, 109, 110, 362/205, 276, 802; 116/7; 273/416

[56] References Cited

U.S. PATENT DOCUMENTS

| | | | |
|---|---|---|---|
| 2,144,858 | 1/1939 | Smith | 362/203 |
| 3,711,694 | 1/1973 | Gronauer | 362/802 |
| 4,340,930 | 7/1982 | Carissimi | 362/204 |
| 4,388,673 | 6/1983 | Maglica | 362/253 |
| 4,421,319 | 12/1983 | Murphy | 273/416 |
| 4,547,837 | 10/1985 | Bennett | 362/186 |
| 4,557,243 | 12/1985 | Eastmann, II et al. | 124/88 |
| 4,704,612 | 11/1987 | Boy et al. | 342/386 |
| 4,749,198 | 6/1988 | Brailean | 273/416 |
| 4,885,800 | 12/1989 | Ragle | 273/416 |
| 4,951,952 | 8/1990 | Saddler | 273/416 |
| 4,989,881 | 2/1991 | Gamble | 273/416 |

*Primary Examiner*—Ira S. Lazarus
*Assistant Examiner*—Sue Hagarman
*Attorney, Agent, or Firm*—Mueller and Smith

[57] ABSTRACT

A lighted nock is provided for an arrow which undergoes an initial acceleration when shot from a bow and thereupon reaches a zero acceleration during flight shortly in front of the bow. The nock is formed of transparent material within which is embedded a light emitting diode. An elongate cavity is positioned within the forward portion of the nock and within that cavity there is slidably located an elongate battery having a rod-shaped forward electrode and a rear face forming a second electrode. An energy storing spring is positioned within the cavity and a second cavity is positioned adjacent the first cavity. Within the second cavity there is located an electrical contact and between the two cavities is a position delimiter formed as an annular silicone ring. As the arrow is shot, the energy storage spring moves into compressive contact with the rearward face of the battery and is compressed to store energy sufficient, upon the arrow reaching zero acceleration, to cause the battery forward rod-shaped end to penetrate the position delimiter and close a circuit. Electrical contact between the second terminal of the diode and the battery is provided by an elongate spring of low spring rate positioned coaxially within the energy storage spring and maintaining continuous abutting contact with the rearward face or terminal of the battery.

22 Claims, 6 Drawing Sheets

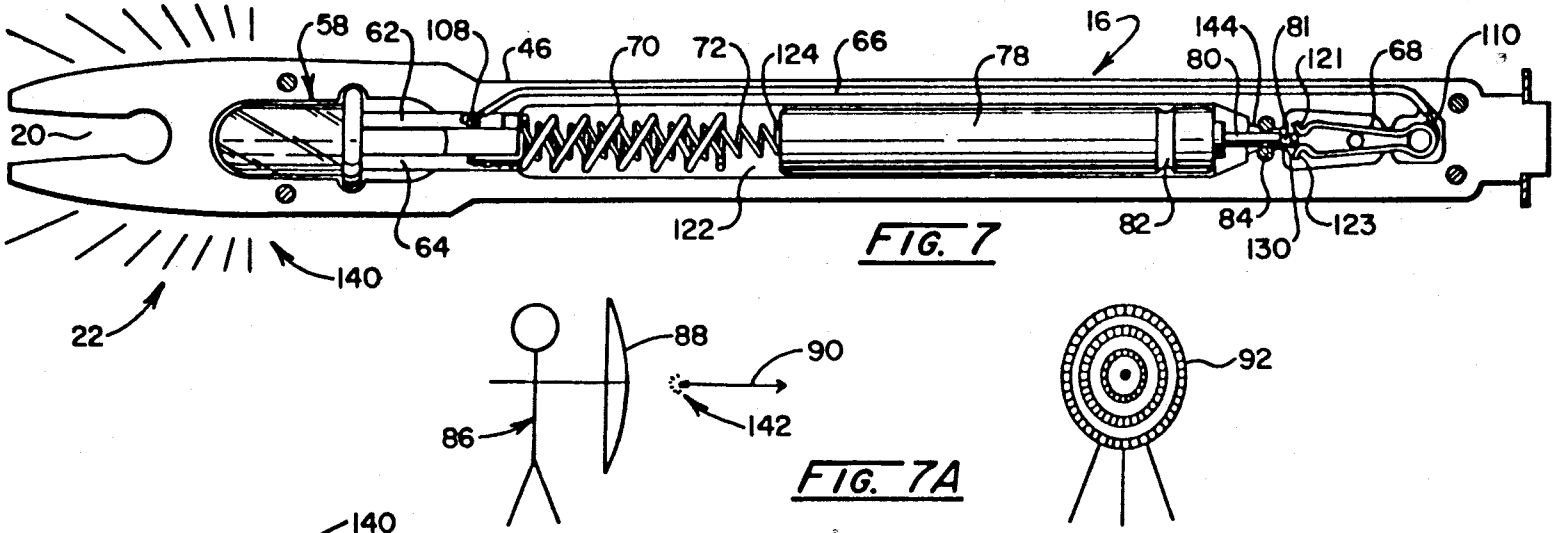
FIG. 7
FIG. 7A
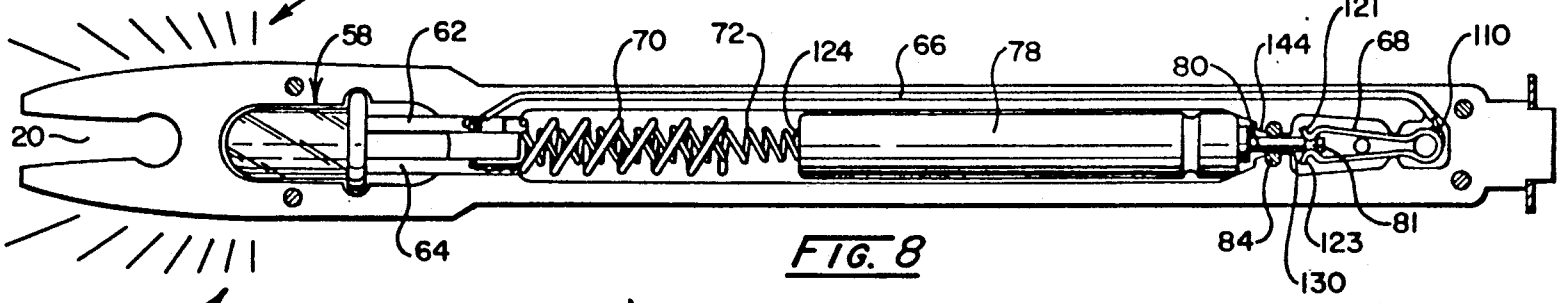
FIG. 8
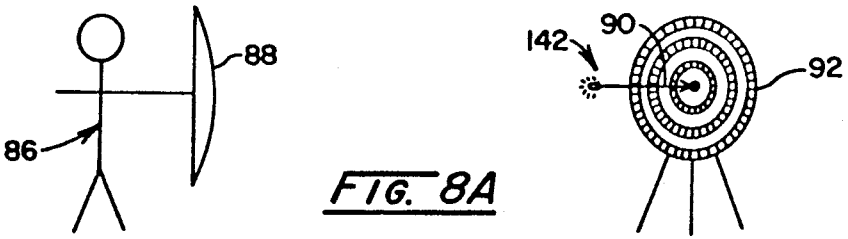
FIG. 8A

ACCELERATION ACTIVATED ENERGIZING DEVICE

BACKGROUND OF THE INVENTION

Investigators in the field of archery, for some time, have recognized the advantages of illuminating the nock end of an arrow for bowhunting. Inasmuch as most hunting is done during low light levels when game are most active or in wilderness areas characterized by dense foliage, there has existed and remains a need for arrows offering enhanced visibility to the hunter as an aid in his or her tracking of game that, even though mortally wounded, continue to wander a considerable distance before falling. Furthermore, arrows, far from being considered expendable by the average hunter, constitute a substantial expense when unlocatable after an errant shot.

Carissimi, as evidenced in his seminal work described in U.S. Pat. No. 4,340,930, was the first to appreciate the superiority of illumination over other tracing devices or methods. Illumination, unlike audible or radio frequency signal tracking techniques, permits the archer to trace an arrow in flight, thereby enabling the observation of its trajectory to the target or its diversion therefrom as a result of contact with branches and the like which may be invisible to the naked eye. Also, audible tracking approaches, having a tendency to frighten game, preclude a hunter from attempting multiple shots. Radio frequency signal based systems, silent to the game, are not disadvantaged in this respect but, because of the necessity of a transmitter and a receiver, are of a cost prohibitive for the average hunter. Tracking devices utilizing a tracing line affixed to the arrow have numerous disadvantages, not the least of which is an increase in aerodynamic drag and the concomitant decrease in arrow velocity and accuracy.

The tracer-like quality of an illuminated arrow in flight also proves worthwhile in archer training. Oscillations or vibrations in an arrow are manifestations of either improper bow configuration or a less than optimal release by the archer. The ability to observe and discern the vibrational characteristics of an arrow on its way to the target, greatly enhanced by an illuminated nock, aids the archer in determining the cause of the malfunction so that corrective measures may be employed.

Moreover, arrows with traceability enhanced through illumination are uniquely advantageous for use in archery tournaments. Insofar as spectators must, by necessity, view the event a considerable distance from the target, their enjoyment of the competition is often lessened by an inability to see the arrow during or subsequent to its penetration into the target. Owing to their excellent visibility, a quality not shared by arrows embodied with the other aforementioned tracking approaches, illuminated arrows alone find utility in archery tournaments.

Although the advantages of illuminated arrow nocks are clear, neither archers nor archery equipment manufacturers have, as yet, embraced the concept. Viewed with an eye towards manufacturing and marketing, the illuminated nocks should be interchangeable with standard arrow nocks and manufacturable at a competitive cost. Carissimi's early work, comprised essentially of a lamp nested within an optically transparent nock, a battery and circuitry nested adjacent the nock in the elongate shaft of the arrow, and a switch on the arrow surface actuable by the archer to effect illumination of the nock prior to arrow launch, was said to be disadvantaged by its complexity including an external switch and its lack of interchangability with existing nocks.

Viewed from an archer's perspective, an illuminated nock should improve arrow visibility without any effect on the archer prior to launch or any effect on the arrow subsequent to launch. A review of the early work leads to the conclusion that these requirements have not, as yet, been satisfied. Some proposed devices require the archer to actuate a rotation switch prior to his nocking of the arrow. Apart from the inconvenience that this additional step engenders, the illuminated nock interferes with the aiming of the archer by creating a veiling luminance at the retina so as to hinder ambient light vision, thereby making target acquisition problematic, especially in low-light situations. Time-delayed switches, while ameliorating the detrimental effects of having an illuminated source adjacent the eye of the archer, necessitate that the arrow be launched a particular predetermined time after nocking.

Arrow performance is adversely affected by devices which propose switches with actuation components externally disposed on the arrow. Any such knobs, levers, buttons, slides or like protuberances disrupt the laminar flow of air around an arrow in flight to produce unacceptable turbulent flow or eddies that decrease both arrow velocity and accuracy.

Arrow performance is also affected by the weight of the arrow inasmuch as arrow velocity varies inversely with arrow mass. Consequently, it is evident that a nock minimizing the addition of weight to the arrow would be most preferred by archers.

Investigators have recognized the advantages of inertially actuated illumination. In theory, an illuminated nock so embodied would not energize until the forces imposed on the arrow during launch actuated the switch. Consequently, the archer would be saved the inconvenience of having to manually operate a switch and would be spared the hindering effects of having a bright light adjacent his or her eye while still afforded the advantage of being able to track the arrow in flight. However, in practice, an inertial switch meeting the requirements of aerodynamic design, light weight, compactness, reliability, and interchangability has not been forthcoming. Additionally, the inertial switches now known require inconvenient and expensive external devices for de-energization subsequent to inertial energization. Thus, there exists a continuing need for an illuminated nock, inertially actuated or otherwise, possessing these features.

SUMMARY

The present invention is addressed to apparatus for energizing a device within an accelerable implement that neither affects the aerodynamics of the implement nor requires switch actuation by the user. This has been accomplished by employing a light weight and economically manufacturable apparatus that may be contained completely internally within the implement, thereby eliminating any additional external protuberances, and that is reliably automatically actuated in response to acceleration-derived forces instead of manually actuated by user manipulation of an external switch. When embodied in an arrow, the apparatus desirably illuminates its nock end in response to the arrow's acceleration when launched from a bow to aid both the archer and the spectator in tracking its flight and for purposes of archer training as a visible indicia of technique deficiencies. Moreover, when utilized by an archer engaged in bowhunting, the illumination provided facilitates the tracking of wounded animals without the need for the archer to actuate a switch prior to his nocking of the arrow which would possibly alert game to his presence and would make aiming difficult due to the veiling luminance a light source adjacent his eye would produce. These desirable features are achieved with the instant invention without any noticeable impariment of the arrow's velocity or accuracy because the apparatus is of low weight and may be incorporated into the arrow without the need for external protuberances such as switches and the like that would hamper aerodynamic stability.

Another feature of the invention is to provide a nock for an arrow having an arrow axis and experiencing an initial acceleration and subsequent zero acceleration when shot from a bow. The nock includes a body member having a light transmissive rearward portion engageable with the bow, and a forward portion insertable within the arrow and having a nock axis substantially alignable with the arrow axis. A light emitting device is mounted within the body member rearward portion and has first and second terminals. A first cavity is disposed within the body member forward portion, aligned with the nock axis and extending from a rearward end to a forward end. A second cavity is disposed within the body member forward portion adjacent the first cavity. A battery is located and freely slideably movable within the first cavity and has a rearward and a first terminal and extends to a forward face from extends a rod-shaped second terminal of given diametric extent. A first contact arrangement for electrically coupling the battery first terminal with the light emitting device first terminal while permitting freely slideable movement is provided and a second contact arrangement is provided within the second cavity which is electrically coupled with the light emitting device second terminal for effecting select contact with the battery second terminal. A position delimiter is located intermediate the first and second cavities and is aligned with the rod-shaped terminal and the second contact arrangement and is forceably penetrable by the rod-shaped terminal under the application of a predetermined force to the battery to effect electrical contact between the battery second terminal and the second contact arrangement.

A further feature of the invention provides apparatus for energizing a device having electrical terminals, mounted with an implement having an axis and accelerable along that axis from an initial to zero acceleration. The apparatus includes a body member having an internal first cavity therein disposed along the axis and extending from a rearward end to a forward end, and having an internal second cavity positioned adjacent the first cavity. A battery of given mass is positioned for freely slideable movement within the first cavity, having a first base defining a first electrode and a second base spaced from the first phase and includes a rod-shaped second electrode of given diameter depending from the second phase. A resilient contact arrangement couples the battery first electrode with one device electrical terminal. An electrical contact arrangement within the second cavity is contactable with the second electrode for effecting electrical communication between the battery second electrode with another device electrical terminal. A position delimiter is disposed intermediate the battery second electrode and the electrical contact arrangement which is penetrable by the rod-shaped second electrode upon slideable movement of the battery under predetermined force to provide circuit completing contact with the electrical contact arrangement.

The invention also features a nock for an arrow having an arrow axis aligned along a hollow shaft and experiencing an initial acceleration and subsequent zero acceleration when shot from a bow. The nock includes an elongate body member having a light transmissive rearward portion engageable with the bow, a forward portion insertable within the shaft and a nock axis aligned with the arrow axis. A light emitting diode is mounted within the body member rearward portion and has first and second terminals. A first elongate cavity is disposed within the body member forward portion, symmetrically disposed about the nock axis and extends from a rearward end to a forward end. A second cavity is disposed within the body forward portion adjacent the first cavity with a channel extending between the first and second cavities. A battery is freely slideably movable within the first cavity and has a rearward end providing a first electrode and extends to a forward face from which extends a rod-shaped second electrode of given diametric extent. A contact spring is located within the first cavity, having a predetermined spring rate, which is electrically coupled with the diode first terminal and extends into continuous electrically communicating abutting contact with the battery rearward end. An electrical contact arrangement is electrically coupled with the diode second terminal and is positioned within the second cavity for effecting select, circuit completing contact with the battery terminal. A position delimiter is located within the channel and is aligned with the rod-shaped second electrode for penetration thereby under the application of a predetermined force to the battery to effect electrical contact with the electrical contact arrangement. An energy storage spring is located within the first cavity in abutting relationship with the first cavity rearward end and is compressively abuttably engageable with the battery rearward end during the arrow acceleration to effect a storage of energy sufficient, when released substantially upon the arrow's attainment of zero acceleration, to slideably move the battery forward under the predetermined force.

Other objects of the invention will, in part, be obvious and will, in part, appear hereinafter.

The invention, accordingly, comprises the apparatus possessing the construction, combination of elements, and arrangements of parts which are exemplified in the following description. For a fuller understanding of the nature and objects of the invention, refer to the following detailed description taken in connection with the accompanying drawings.

BRIEF DESCRIPTION OF THE DRAWINGS

FIG. 7 is a sectional view in the manner of FIG. 5 but showing the orientation of components therein where the arrow within which the nock is mounted has approached or undergone zero acceleration;

FIG. 7A is a symbolic representation of the archer, bow, arrow and target of FIG. 5A showing the position of an arrow during which the component organization of FIG. 7 will be experienced;

FIG. 8 is a sectional view in the manner of FIG. 5 but showing the orientation of components after the arrow within which the nock is mounted has decelerated into a target;

FIG. 8A is a symbolic representation of the archer, bow, arrow, and target of FIG. 5A but showing the positioning of the arrow striking or having struck a target;

DETAILED DESCRIPTION OF THE INVENTION

Figure 1:
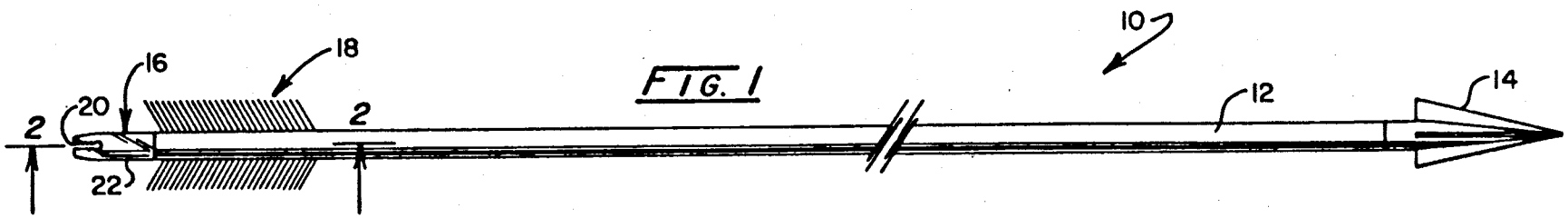
FIG. 1 is a side elevational view of an arrow having an nock incorporating an energizing apparatus for effecting its illumination according to the present invention.

While the dynamically responsive implement energizing apparatus of the invention may have a broad variety of applications calling for an acceleration based actuation of a switch, its premiere application is in conjunction with a lighted arrow nock. Looking to FIG. 1, an arrow is represented generally at 10 incorporating the conventional components employed in recreational archery. In this regard, the arrow devices 10 generally are made up of a tubular, elongate shaft or body 12 constructed of, for example, fiberglass, graphite, or aluminum. Shaft 12 extends forwardly to a conventional arrowhead 14 and rearwardly to a nock 16, the rearward component 22 thereof being revealed in this figure. Arrowhead 14 may have a variety of configurations, for example the broad head type illustrated. These heads generally are formed of a stainless steel. Applied to shaft 12 forwardly of nock 16 is fletching 18 extending outwardly radially therefrom and typically composed of three symmetrically disposed "vanes" formed of avian feathers, or alternatively, with plastic material. The nock 16 is configured having a notch 20 across one end for the purpose of engaging the string of the bow. Such nocks as at 16 must be formed of a material which can withstand the substantial forces imposed upon the arrow 10 in the course of being shot from a bow. Typically the nocks are formed of a strong plastic material, for example a polycarbonate resin, such as "Lexan" marketed by General Electric Corp. and are of relatively elongate dimension, being glued within the hollow interior of the shaft 12. Practitioners generally will utilize a heat releasing but strong glue for this purpose such that the nocks 16 may be reused with replacement shafts 12. The nock 16, as provided in accordance with the present invention carries a light emitting diode which illuminates the rearward portion thereof as well as a battery and a dynamically actuated switching arrangement for turning the LED on only when the arrow 10 has been released under acceleration from a bow and has reached a dynamic condition of approximately zero acceleration or maximum velocity.

Figure 2:
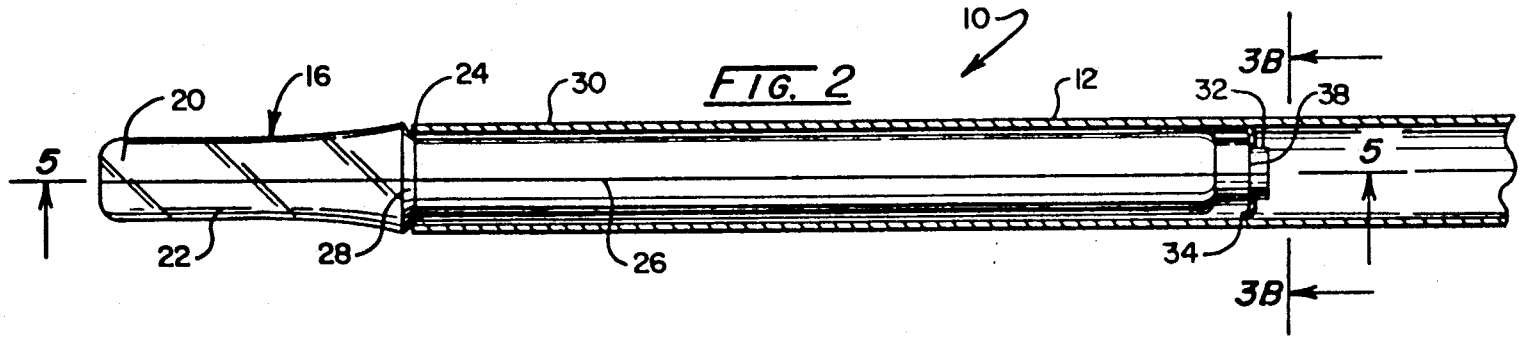
FIG. 2 is a partial sectional view taken through the plane 2—2 in FIG. 1 showing the attachment of a nock component according to the invention with the shaft of the arrow of FIG. 1.

Looking to FIG. 2, the nock 16 is revealed to have a somewhat elongate configuration including the earlier noted rearward component 22 as seen extending outwardly from the rearward edge 24 of shaft 12 and which is integrally formed with a cylindrically shaped forward body portion 26. Body portion 26 joins the rearward component 22 at a beveled edge contact surface 28 configured for achieving a substantially uniform compressive force transfer contact with the shaft edge 24. The beveled surface 28 is seen to be configured in the manner of a truncated cone.

Figure 3B:
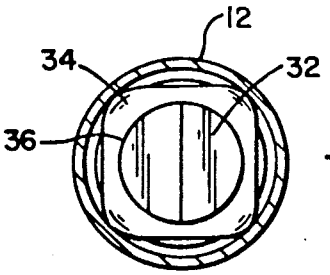
FIG. 3B is a sectional view taken through the plane 3B—3B shown in FIG. 2.
Figure 3A:
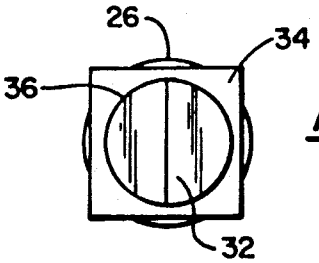
FIG. 3A is a front view of a nock configured according to the present invention.

Forward body portion 26 is seen dimensioned having a diametric extent permitting the existence of a small annular gap 30 to be formed between its outer surface and the inwardly disposed surface of the tubular shaft 12. This permits the insertion of the earlier-noted glue for mounting nock 16 within the shaft 12. Alignment of the centerline of the nock 16 with the corresponding centerline of the shaft 12 is, of course, important. To facilitate this alignment, the forwardmost end of forward body portion 26 is constructed in a cylindrical cross-sectional fashion, but of lesser diametric extend than body portion 26. This forwardly depending nub 32 is configured coaxially with the axis of nock 16 and serves to support a thin square spacer 34 which is seen more clearly in FIG. 3A. Looking to that figure, the spacer 34, being square, is seen to have four protruding corners when not inserted within the shaft 12 and is further formed having an internal circular opening 36 which permits it to be slideably mounted upon the nub 32. With the arrangement seen in FIG. 3A, as the forward body portion 26 of the nock 16 is slideably inserted within the hollow interior of shaft 12, the corners of the spacer 34 are bent rearwardly while additionally functioning to position the nock central axis is coaxial alignment with the axis of arrow 10. This rearward folding of the spacer edges is seen both in FIGS. 2 and 3B. It may be observed in FIG. 2 that a small shoulder 38 is formed in nub 32 to assure properly aligned seating of the spacer 34 upon the nub.

Figure 4:
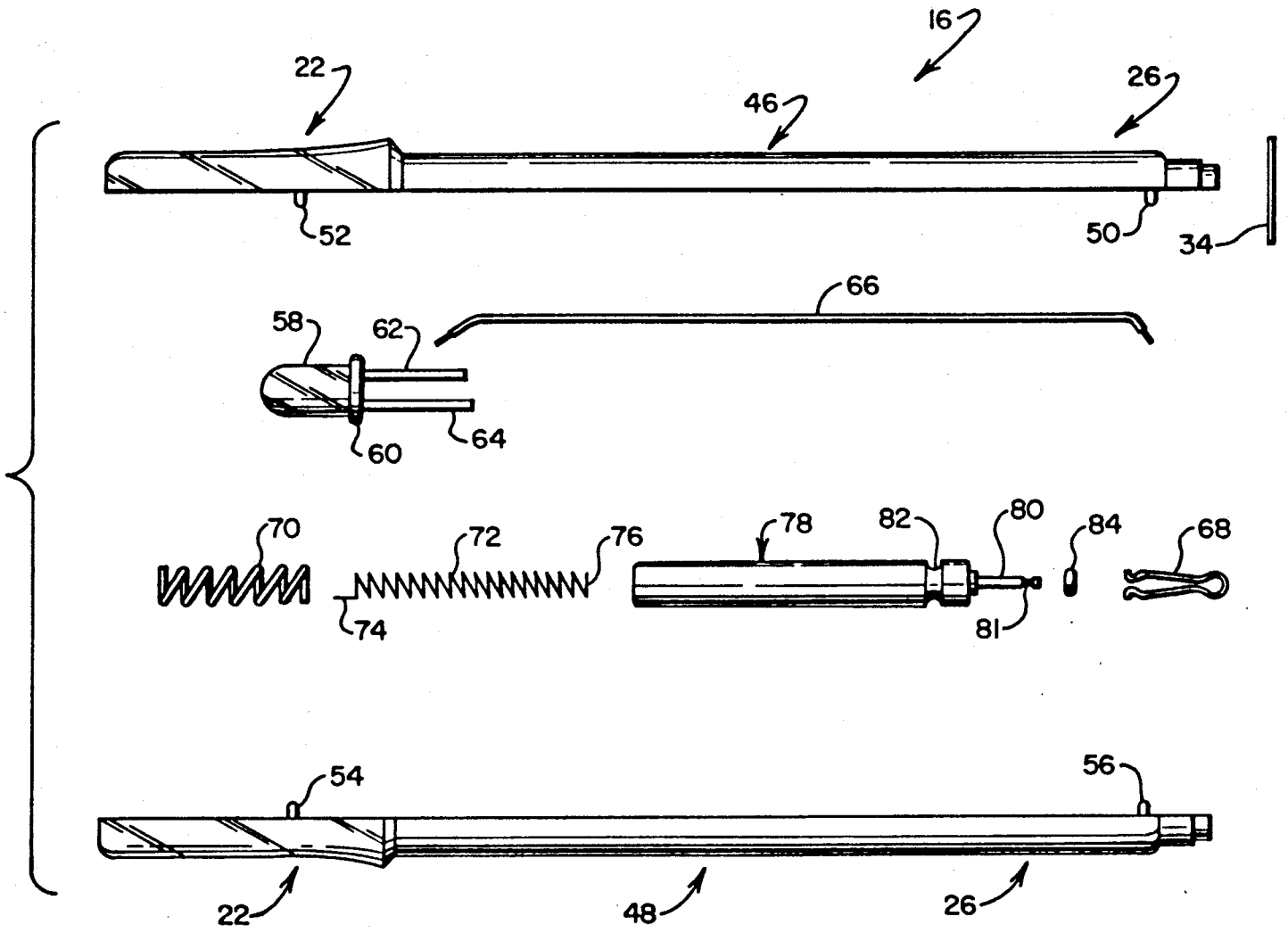
FIG. 4 is an exploded view of the nock shown in FIG. 2.

Turning to FIG. 4, an exploded representation of the components of nock 16 is revealed. The body portion of the nock 16 is formed of two identical, longitudinally parted halves herein represented at 46 and 48. The halves are molded with alignment cavities and alignment pins, the latter being shown at 50 and 52 in the case of body half 46 and at 54 and 56 in the case of body half 48. Body halves 46 and 48 join together and are glued in conjunction with the insertion of internal components which include a light emitting diode (LED) 58 which, for example, may be of indirect bandgap double heterojunction (DH) AlGaAs/GaAs material technology. Such LEDs exhibit a high output efficiency over a wide range of drive currents. One such LED is marketed, for example, by the Hewlett Packard Corporation is a type HLMP 8100 having a minimum axial luminous intensity at 25° C. of 290 mCD and at 20 mA, a typical output of 700 m CD at 20 mA and exhibits a viewing angle of about 24°. Note that the LED 58 is configured having an integrally formed shoulder component 60 from which electrical terminals 62 and 64 extend. Terminal 62 will be seen to coupled by an elongate thin electrically conductive copper strap 66 to a transversely deflectable receptor spring shown at 68. A thin wire lead also may be used for this function. Also retained within the assemblage is a helical energy storage spring 70 which will be seen to extend about a reversely wound tin plated wire stack helical electrical contact spring 72. Note that spring 72 is of lesser diametric extent than spring 70 and includes a small contact forming rearwardly extending portion 74 intended for soldered or like connection with, for example, the terminal 64 of LED 58. The opposite end 76 of electrical contact spring 72 is intended for contact with the rearwardly facing electrode defining surface of a tin plated battery 78. In general, the spring rate of spring 72 will be substantially lower than that of spring 70. Battery 78 is seen to be cylindrical in shape having a first electrode formed of the tin plated outer cylindrical surface thereof and a second electrode 80 which extends centrally of the forward or top surface thereof. The battery may be provided, for example, as a type BR435 marketed by the battery sales division of Panasonic Industries Company, a division of Matsushita Electric Corporation of America. Battery 78 further includes an annular groove or channel 82 extending about the forward portion thereof. Rod 80 is of given diametric extent will be seen to cooperate with a "doughnut" or torus shaped position delimiter 84 having an internally disposed opening formed centrally therein. Rod 80 further includes an annular groove or channel 81 extending about the forward portion thereof.

Figure 5:
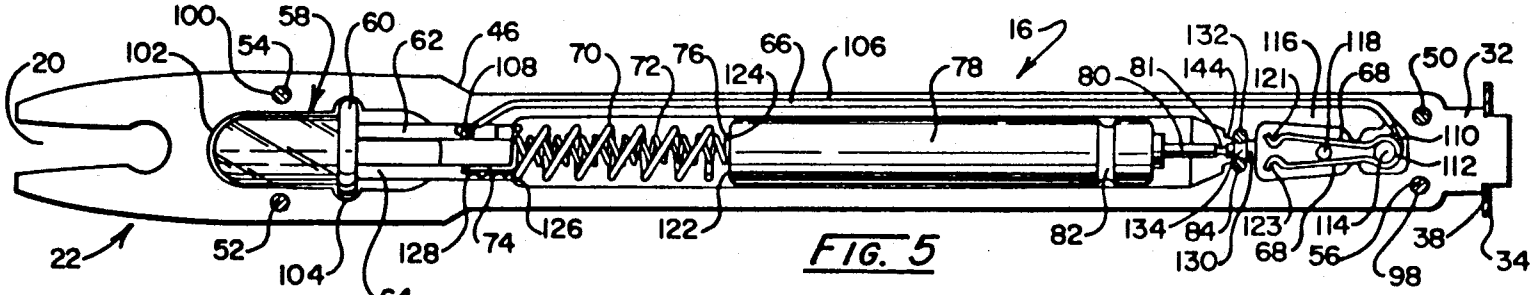
FIG. 5 is a sectional view of the nock of FIG. 2 taken through the plane 5—5 therein and showing the components thereof in a state of rest.
Figure 5A:
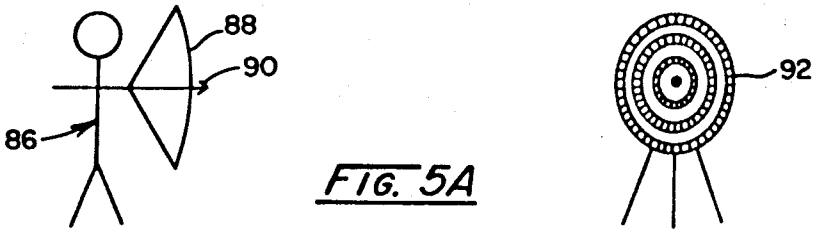
FIG. 5A is a schematic portrayal of an archer with bow and arrow as well as a target showing the position of the archer and arrow for the component association shown in FIG. 5.

Looking additionally to FIG. 5, a sectional portrayal of the components of the nock 16 under conditions where the nock is operationally at rest is revealed. The orientation of components would correspond, for example, to a condition wherein the bowman or the archer is preparing to release an arrow but has not done so. Looking additionally to FIG. 5A, a "stick man" archer 86 is represented hold a bow 88 and arrow 90 in this pre-flight orientation prior to firing towards a target schematically represented at 92.

Returning to FIG. 5, the nock 16 longitudinal portion 46 is again shown revealing the alignment pins 50 and 52 and oppositely associated alignment holes 98 and 100 which are shown receiving the corresponding alignment pins 54 and 56 from portion 48. The latter pins are represented in section in the figure. LED 58 is seen to be located within an LED cavity 102, its securement being assured by an annular groove 104 formed within rearward component 22 of nock 16. In general, the nock 16 is formed of a transparent or translucent material so as to permit the transmission of light from LED 58 outwardly from rearward portion 22. A slot is formed in each of the components 46 and 48, one side of which is shown at 106 for the purpose of supporting and carrying the copper strap or wire 66. Note in this regard that the strap or wire 66 is electrically coupled by parallel gap resistance soldering. At coupling 108 to electrode 62 of LED 58. The opposite end of strap or wire 66 extends forwardly within slot 106 to an electrical coupling 110 connecting it with receptor spring 68. Spring 68 includes a forward loop portion 112 which is positioned over the pin 114 integrally formed within component 46. Additionally, the spring 68 is seen to be located within a forward cavity 116 and the ends of which also extending on either side of a second alignment pin 118. The rearwardly open facing tines or ends of the switch 68 are bent outwardly at 121 and 123 to facilitate their outward deflection and reception of the rod electrode 80 of battery 78.

Battery 78 is seen to be positioned within an elongate cavity 122 aligned with the axis of nock 16. Cavity 122 is dimensioned such that the battery 78 is freely slideable therein and the rearward face of the battery at 124 is seen, as earlier noted, to be in electrical contact with forward portion 76 of electrical contact spring 72. Forward portion 76 of electrical contact spring 72 is coupled by opposing electrode resistance soldering to battery 78, thus, eliminating possible circuit interruption due to the development of oxides which would hamper contact between battery 78 and contact spring 72. Note that this spring 72 extends within energy storage spring 70 to an abutting contact with the rearward end surface 126 of cavity 122. The contact extension 74 of spring 72 is coupled, for example by parallel gap resistance soldering contact 128 with electrode 64 of LED 58. Spring 72 functions to maintain a constant or continous electrical connection between the rearward face or electrode surface 124 of battery 78 and the electrode 64 of LED 58.

Portions 46 and 48 are formed such that an open channel 130 is created between the cavity 122 and cavity 116. Within this channel 130 there is formed an annular groove 132 for receiving and defining the position delimiter 84. Note that the delimiter 84 has an internal opening 134 which, with the arrangement shown, is aligned with the rod-shaped electrode 80 of battery 78. However, for the rest condition at hand, the rod 80 remains within the cavity 122, the forward tip thereof being shown engaging the position delimiter 84. In general, the diametric extent of opening 134 of delimiter 84 is less than that of the corresponding diameter of rod diametric extent of rod electrode 80. Thus, for the rest condition illustrated, the rod 80 will remain substantially within the cavity 122. Delimiter 84 may be provided as a conventional O-ring, formed, for example, of a relatively hard silicone rubber such as type AS568-001, marketed by R. T. Enterprises. The internal diametric extent of opening 134 for such material is selected, for example, as being about 30% less than the corresponding diametric extent of rod electrode 80. Thus, for the rod electrode 80 to penetrate the position delimiter 84, a predetermined amount of forward force is required to overcome the friction exhibited by such penetration association. The harder material for device 84 is preferred over softer materials which exhibit a preliminary friction or "grab" sometimes referred to as "stiction".

With the arrangement shown for a rest condition, it may be observed that no energy is stored within the energy storage spring 70, the battery 78 is located within cavity 122 such that forward rod shaped electrode 80 has not penetrated the position delimiter 84 and thus, no contact between that rod 80 and the contact spring 68 has been made. Thus, the LED 58 is not illuminated and is not bothersome, for example, by creating veiling luminance at the retina of the archer 86. However, the archer 86 has not been called upon to turn on any switches or the like, the arrow 90 being used in the same manner as any non-illuminated arrow.

Figure 6:
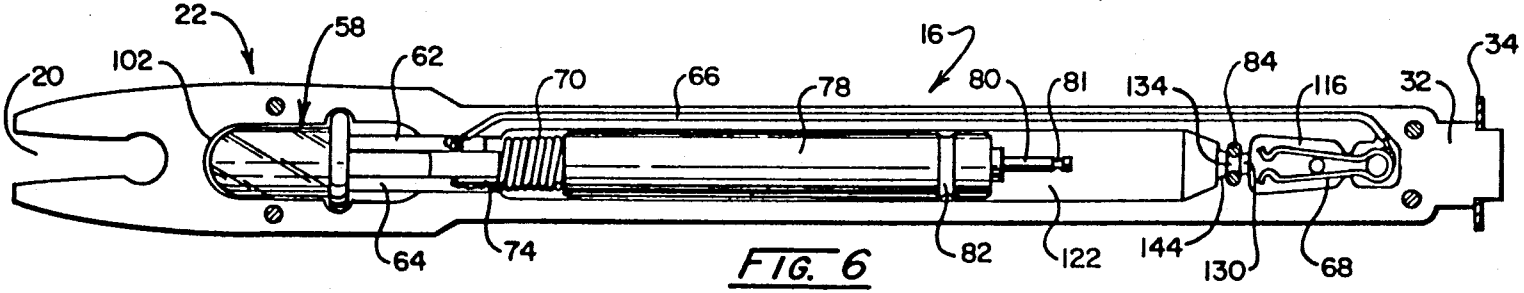
FIG. 6 is a sectional view in the manner of FIG. 5 but showing the components of the nock as they experience acceleration.
Figure 6A:
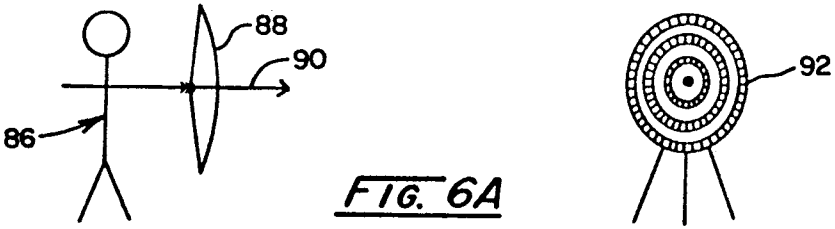
FIG. 6A is a schematic portrayal of the archer, bow, arrow, and target of FIG. 5A as the arrow experiences high acceleration forces.

Looking to FIGS. 6 and 6A, the orientation of the components of the nock 16 are revealed as the archer 86 has released the arrow 90 from bow 88 towards target 92. At this time, the nock 16 has moved away from the battery 78 and has caused the energy storage spring 70 to be compressed, the lower rate spring 72 also being compressed within spring 70. Battery 78 as seen in FIG. 6 is now at the rearward extreme of the chamber 122. In general, the arrow 90 will be leaving the bow 88 as maximum acceleration is achieved to evolve the instant component orientation. As in the case of FIG. 5, the LED 58 is not illuminated.

Turning to FIGS. 7 and 7A, the orientation of components within the nock 16 are revealed as the arrow as represented at 90 in FIG. 7A achieves or approaches zero acceleration. At this time, the energy stored within spring 70 has been released to propel the battery 78 forwardly such that the rod electrode 80 thereof has been pushed through opening 134 of the position delimiter 84. To facilitate the entry of rod shaped electrode 80 into the opening 134 of position delimiter 84 and through the open channel 130, the entrance to the channel 130 at cavity 122 is made conical in general configuration as represented at 144. The energy so imparted from spring 70 is such that the electrode 80 now has made contact with receptor spring 68 urging the forward end components 121 and 123 thereof outwardly to close the circuit to electrode 62 of LED 58. In this regard, as the rod shaped electrode 80 is urged through the insulative position delimiter 84 and makes contact with spring 68, spring 68, in turn, conducts through electrical coupling 110 to copper strip 66 which, in turn, is coupled at electrical coupling 108 to electrode 62. On the other hand, electrode 64 of LED 58 is electrically coupled to electrical contact spring 72 which, in turn, is electrically coupled with the rearward face 124 of battery 78. As represented at luminant symbol 140 in FIG. 7, the nock 16 is now illuminated. FIG. 7A reveals that this illumination occurs as represented at 142 at about the time the arrow 90 leaves the bow 88. It is opined that the rod electrode 80 will continue to penetrate spring 68 from the orientation illustrated as the instant condition of arrow flight is achieved.

Referring to FIGS.8 and 8A, the orientation of components of the nock 16 as the target is hit are revealed. In this regard, FIG. 8A shows the arrow 90 in an orientation having struck the target 92 and the nock thereof remains illuminated as represented by the luminance symbol 142. The deceleration of striking the target may cause the battery 78 to move further forwardly under momentum if it has not earlier achieved the terminal position shown. Note that the rod-shaped electrode 80 thereof now has been moved through the position delimiter 84 and open channel 130. Thus, the endings 121 and 123 of receptor spring 68 have opened and, in effect, are engaging the surface of the rod-shaped electrode 80, enabling the nock to remain lighted. In this regard, a form of hysteresis is achieved in the illumination of LED 58. The receptor spring 68 has a tendency to grasp the rod shaped electrode 80. This is facilitated by annular groove or channel 81 which mates with the ends 121 and 123 of receptor spring 68 and inhibits rod-shaped electrode 80 from experiencing reverse reaction or bouncing toward the rear of chamber 122. Important electrical contact between the receptor spring 68, ends 121 and 123, and the rod electrode 80 is enhanced by the cleansing wiping action which occurs with this circuit feature. Because of the engaging quality of that feature, LED 58 will tend to remain illuminated even though the arrow may be undergoing dynamics associated with an animal target.

The return of the nock 16 to the rest orientation representing in FIG. 5 from the full on orientation shown in FIG. 8 is simple. In this regard, the arrow is removed from the target and the rearward component 22 of nock 16 is tapped against a hard surface. This causes the battery 78 to move rearwardly to the orientation shown in FIG. 5. LED 58 then is off and the nock 16 has resumed its state of rest. Thus, an off switching technique is made available without any exteriorly mounted switching devices or the like.

Figure 9:
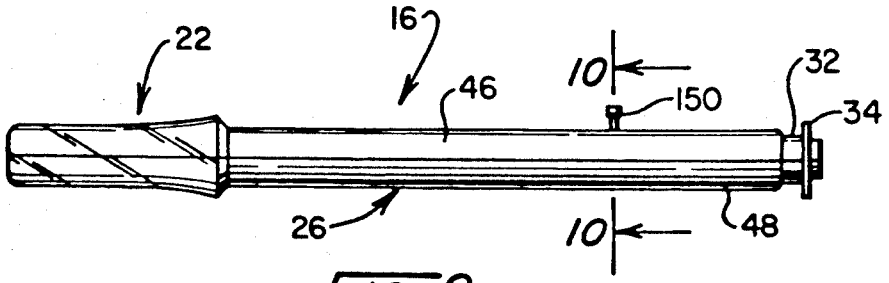
FIG. 9 is a side view of the nock of FIG. 2 showing the insertion therein of a shipping pin.
Figure 10:
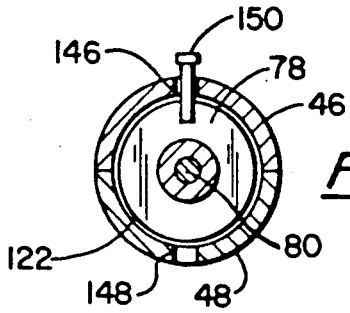
FIG. 10 is a sectional view taken through the plane 10—10 in FIG. 9.

The nocks 16 are preassembled prior to shipping, including the positioning of batteries as at 78 therein. To assure that inadvertent shipping dynamics do not turn the nocks on, for example by asserting a hard shock at the forward component 32, small holes are molded in the forward portion 26 thereof, for example, as described in connection with FIG. 4 within each of the components 46 and 48. A small plastic pin then may be inserted in that hole to retain the battery 78 in the rearward orientation shown in FIG. 5 or even further rearwardly. Referring to FIG. 10, openings 146 and 148 are seen formed in components 46 and 48. One of these openings then may receive a shipping pin as at 150 as seen additionally in FIG. 9. The pin 150 may engage either the groove 82 (FIG. 4) and battery 78 or the position forwardly of the forward face of the battery.

Figure 11:
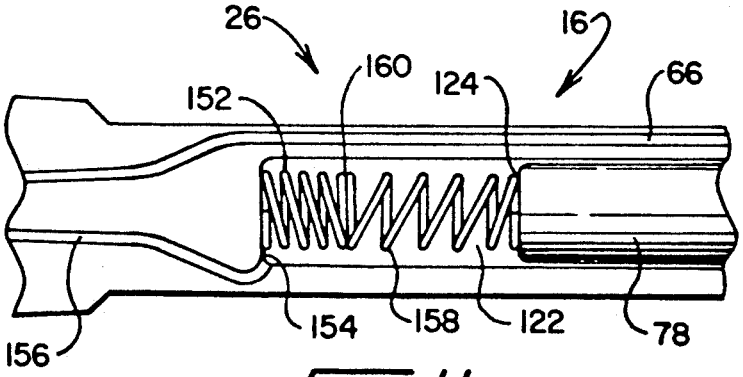
FIG. 11 is a partial sectional view of a nock showing an alternative arrangement for energy storage and electrical contact springs.

The above discourse describes the preferred embodiment for the nock 16. However, other techniques for carrying out essentially this same form of switching are available. Looking to FIG. 11, the nock 16 again is reproduced in conjunction with battery 78, cavity 122, and the forward extending lead strap 66. In the arrangement of FIG. 11, two springs of the same diameter but having different rates are combined coaxially or in line. In this regard, the lower rate spring serving the continuous contact function is revealed at 152 electrically coupled, for example, to electrode 64 (not shown) at coupling 154 and through lead 156. Spring 152 assumes the function of electrical contact spring 72. The energy storage spring function is provided by spring 158. Spring 158 has the same diameter as spring 152 and they are joined together at common junction 160. The opposite side of spring 158 is coupled to the rearward face 124 of battery 78. As is apparent, the spring rate of energy storage spring 158 is much greater than that of the contact spring 152. Springs 152 and 158 carry on the same functions as earlier described respective springs 72 and 70.

Figure 12:
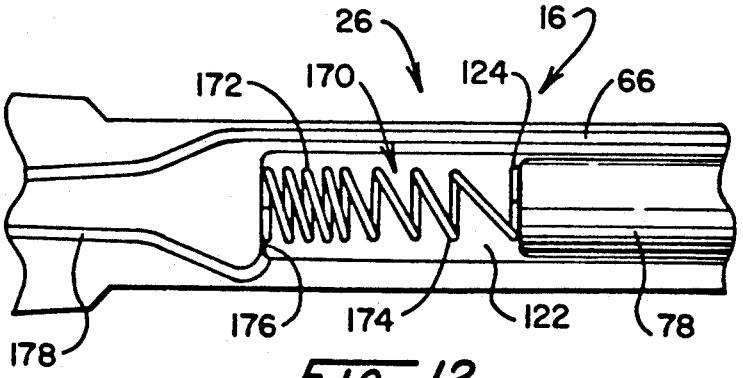
FIG. 12 is a partial sectional view of another embodiment of a nock according to the invention showing a dual rate spring employed for the function of energy storage and electrical contact.

Looking to FIG. 12, a similar embodiment is revealed. In this regard, a singular spring with dual spring rates is employed as represented in general at 170. Spring 170 incorporates a closely wound lower spring portion 172 and an more open wound portion of higher spring rate at 174, the forward tip of which is electrically coupled by soldering or the like to the rearward face 124 of battery 78. As before, the rearward component of the spring 170 is coupled at 176 to a lead 178 extending to one electrode of LED 58 (not shown).

Figure 13:
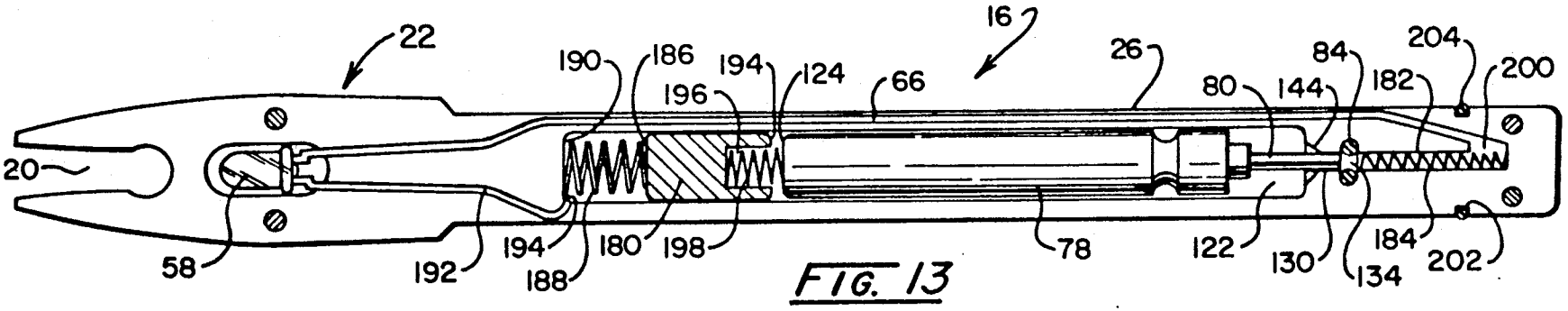
FIG. 13 is a sectional view of another embodiment of a nock according to the invention showing the utilization of a nock element and a coil form of receptor spring.

Looking to FIG. 13, another embodiment for an illuminated nock 16 is revealed. Where the same components are employed, the same identifying numeration is employed in this figure. The embodiment shown in this figure is characterized by two components, one an energy storage element or mass 180 and, additionally, an electrical contact coil spring 182 serving the spring receptor function and within a narrow cylindrical forward cavity 184.

Energy storage element 180 is cylindrical in shape and formed of a material, for example such as copper, which is electrically conductive. The rear surface 186 of element 180 is seen to be in abutment with an energy storage spring 188 which abuts against the rearward face 190 of cavity 122. Electrical connection with LED 58 is through lead 192 which is coupled to the spring 188 at 194. Element 180 is counterbored at its forward face 194 to form a spring retention cavity 196. Within cavity 196 there is positioned an electrical contact spring 198 which abuts against the rearward face 124 of battery 78. Preferably, a soldering form of connection is created at that face 124.

Broad shaped electrode 80 of battery 78 is seen entering the channel 130 and is positioned adjacent the opening 134 within position delimiter 84. Electrical contact or receptor spring 182 is electrically coupled to strap 66 at connection 200.

With the arrangement shown, upon the application of acceleration to the nock, 16, energy storage spring 188 is compressed by the combined masses of battery 78 and mass component or element 180. As zero acceleration occurs, the spring 188 will propel mass element 180 forwardly along with battery 78 to cause the rod-shaped electrode 80 to penetrate position delimiter 84 and make contact with the receptor spring 182, compressing spring. A return to a rest state is accomplished in the same manner as the earlier embodiments, by tapping the nock against a rigid surface at its rearward portion 22. Another embodiment for aligning the nock within the inside of an arrow is shown in FIG. 13, in this regard, a groove 202 is formed in the forward portion 26 thereof. Within the groove 202 there is positioned a flexible O-ring 204 which aligns the nock within the interior of the shaft of an arrow.

Since certain changes may be made in the above system and apparatus without departing from the scope of the invention herein involved, it is intended that all matter contained in the above description or shown in the accompanying drawings shall be interpreted as illustrative and not in a limiting sense.

We claim:

1. Apparatus for energizing a device having electrical terminals, mounted with an implement having an axis and accelerable along said axis from an initial to zero accleration, comprising:

a body member having an internal first cavity therein disposed along said axis and extending from a rearward end to a forward end, and having an internal second cavity positioned adjacent said first cavity;

a battery of given mass positioned for freely slideable movement within said first cavity, having a first face defining a first electrode, and second face spaced from said first face and a rod-shaped second electrode of given diameter depending from said second face;

resilient contact means coupling said battery first electrode with one said device electrical terminal;

electrical contact means within said second cavity, contactable with said second electrode for effecting electrical communication between said battery second electrode with another said device electrical terminal; and a position delimiter disposed intermediate said battery second electrode and said electrical contact means, penetrated by said rod-shaped second electrode upon slideable movement of said battery under predetermined force to provide circuit completing contact with said electrical contact means.

2. The apparatus of claim 1 including energy storage spring means located within said first cavity in alignment with said axis, having one end in abutting engagement with said first cavity rearward end and an opposite end movable into compressive engagement with said battery first face substantially during said acceleration and urging said battery second electrode to penetrate said position delimiter substantially commencing with said zero acceleration.

3. The apparatus of claim 2 in which said resilient contact means comprises a coil spring located within said first cavity, having one end electrically cooled with one said device electrical terminal and having an opposite end extending into continuous abutting contact with said battery first face.

4. The apparatus of claim 1 in which said position delimiter is an elastic annular component having a centrally disposed opening therein of predetermined diametric extent.

5. The apparatus of claim 4 in which said diametric extent of said elastic annular component opening is less than said given diameter of said rod-shaped electrode.

6. The apparatus of claim 1 in which said electrical contact means comprises a generally U-shaped spring assembly having two spaced leg components transversely resiliently movable in frictional engagement with the surface of said battery rod-shaped second electrode.

7. A nock for an arrow having an arrow axis and experiencing an initial acceleration and subsequent zero acceleration when shot from a bow, comprising:

a body member having a light transmissive rearward portion engageable with said bow, and a forward portion insertable within said arrow and having a nock axis substantially alignable with said arrow axis;

a light emitting device mounted within said body member rearward portion and having first and second terminals;

a first cavity disposed within said body member forward portion, aligned with said mark axis and extending from a rearward end to a forward end;

a second cavity disposed within said body member forward portion adjacent said first cavity;

a battery located and freely slideably movable within said first cavity and having a rearward end and a first terminal extending to a forward face from which extends a rod-shaped second terminal of given diametric extent;

first contact means for electrically coupling said battery first terminal with said light emitting device first terminal while permitting said freely slideable movement;

second contact means within said second cavity, electrically coupled with said light emitting device second terminal for effecting select contact with said battery second terminal; and a position delimiter positioned intermediate said first and second cavities, aligned with said rod-shaped terminal and said second contact means and forcibly penetrable by said rod-shaped terminal under the application of a predetermined force to said battery to effect electrical contact between said battery second terminal and said second contact means.

8. The nock of claim 7 including spring means located within said first cavity in abutting relationship with said first cavity rearward end for compressive abutting engagement with said battery rearward end during said arrow acceleration to effect a storage of energy sufficient, when released substantially upon attainment of said zero acceleration, to slideably move said battery to effect said position delimiter penetration by said rod-shaped second terminal.

9. The nock of claim 8 in which said spring means comprises a helical spring having a spring rate selected to effect said storage of energy.

10. The nock of claim 8 in which said spring means comprises a helical spring structure in electrical communication with said light emitting device first terminal and having a length selected to comprise said first contact means by maintaining electrical communication with said battery first terminal at said rearward end.

11. The nock of claim 10 in which said helical spring structure is configured having a first spring rate portion selected to effect said energy storage and a second spring rate portion of value less than said first spring rate comprising said first contact means.

12. The nock of claim 8 in which:

said spring means comprises a coil energy storage spring having a spring rate selected to effect said storage of energy; and said first contact means comprises a coil contact spring of length sufficient to maintain continuous abutting and contact with said first battery terminal at said battery rearward end.

13. The nock of claim 12 in which said energy storage spring is aligned with said nock axis; said contact spring is counterwound with respect to said energy storage spring and extends internally within said energy storage spring to said first cavity rearward end.

14. The nock of claim 12 further comprising an energy storage element of predetermined mass slideably located within said first cavity intermediate said energy storage spring and said contact spring.

15. The nock of claim 7 in which said position delimiter is of annular form, having an inwardly disposed opening of diametric extent less than the diametric extent of said battery rod-shaped second terminal end and selected to retain said battery rod-shaped second terminal within said first cavity until slideably moved under said predetermined force.

16. The nock of claim 15 in which said position delimiter is formed of an elastic material.

17. The nock of claim 15 in which said position delimiter is formed of silicon rubber.

18. The nock of claim 7 in which said second contact means comprises a bifurcate spring having two spaced leg components transversely movable in frictional engagement with the surface of said battery rod-shaped second terminal.

19. The nock for an arrow having an arrow axis aligned along a hollow shaft and experiencing an initial acceleration and subsequent zero acceleration when shot from a bow, comprising:

an elongate body member having a light transmissive rearward portion engageable with said bow, and forward portion insertable within said shaft and having a nock axis aligned with said arrow axis;

a light emitting diode mounted within said body member rearward portion and having first and second terminals;

a first elongate cavity disposed within said body member forward portion, symmetrically disposed about said nock axis and extending from a rearward end to a forward end;

a second cavity disposed within said body forward portion adjacent said first cavity;

a channel extending between said first and second cavities;

a battery, freely slideably movable within said first cavity and having a rearward end providing a first electrode and extending to a forward face from which extends a rod-shaped second electrode of given diametric extent;

a contact spring within said first cavity, having a predetermined spring rate, electrically coupled with said diode first terminal and extending into continuous, electrically communicating abutting contact with said battery rearward end;

electrical contact means electrically coupled with said diode second terminal positioned within said second cavity for effecting select circuit coupling contact with said battery second terminal;

a position delimiter located within said channel, aligned with said rod-shaped second electrode for penetration thereby under the application of a predetermined force to said battery to effect electrical contact with said electrical contact means; and an energy storage spring located within said first cavity in abutting relationship with said first cavity rearward end and compressively abuttably engageable with said battery rearward end during said arrow acceleration to effect a storage of energy sufficient, when released substantially upon said arrow's attainment of said zero acceleration, to slideably move said battery forwardly under said predetermined force.

20. The nock of claim 19 in which said position delimiter is an elastic annular component having a centrally disposed opening therein of predetermined diametric extent less than said second electrode given diametric extent.

21. The nock of claim 19 including a thin, flexible sheet spacer means coupled with sid body member forward portion for flexural engagement with the interior of said hollow shaft to effect the alignment of said nock axis with said arrow axis.

22. The nock of claim 21 in which said spacer means is formed as a rectangular sheet mountable over said body member forward portion.

* * * * *